US005729853A

United States Patent [19]

Thompson

[11] Patent Number: 5,729,853

[45] Date of Patent: Mar. 24, 1998

[54] LOW AIR LOSS BED WITH AIR PRESSURE SENSOR

[75] Inventor: Martin Stuart Thompson, Kent, England

[73] Assignee: Egerton Hospital Equipment Limited, Kent, England

[21] Appl. No.: 750,382

[22] PCT Filed: May 25, 1995

[86] PCT No.: PCT/GB95/01191

§ 371 Date: Apr. 21, 1997

§ 102(e) Date: Apr. 21, 1997

[87] PCT Pub. No.: WO95/31919

PCT Pub. Date: Nov. 30, 1995

[30] Foreign Application Priority Data

May 25, 1994 [GB] United Kingdom ..... 9410490

[51] Int. Cl.[6] ..... A47C 27/10; A47D 7/057

[52] U.S. Cl. ..... 5/713; 5/714

[58] Field of Search ..... 5/713, 714, 710

[56] References Cited

U.S. PATENT DOCUMENTS 4,797,962 1/1989 Goode ..... 5/713
4,995,124 2/1991 Wridge ..... 5/713
5,020,176 6/1991 Dotson ..... 5/713

FOREIGN PATENT DOCUMENTS

A 0 260 087 3/1988 European Pat. Off. .
A 2 083 865 12/1971 France .
A 33 20 771 12/1984 Germany .

*Primary Examiner*—Alexander Grosz
*Attorney, Agent, or Firm*—Kinney & Lange, P.A.

[57] ABSTRACT

An air-loss mattress (1) to which air under pressure is supplied from a source, control apparatus (2) for controlling the supply of air under pressure from the source to the air-loss mattress through a connector which form part of the mattress, and means included in the control apparatus for setting a required pressure of air flow to the mattress, the air-loss mattress being characterized in that it includes a manifold conduit (25) connected to the source of air under pressure through an outlet pipe (26) of the control apparatus, an open-ended tube (27) connected at one end to pressure recording means of the control apparatus with its free end positioned within the manifold conduit (25) to provide a direct measure of the pressure of air present within this manifold, and means for automatically varying the rate at which air is supplied to the mattress from the source in dependence upon differences existing between the pressure recorded by the pressure recording means and the set pressure in a sense to minimize such differences.

4 Claims, 3 Drawing Sheets

LOW AIR LOSS BED WITH AIR PRESSURE SENSOR

FIELD OF THE INVENTION

This invention relates to beds and to apparatus for controlling the supply of air under pressure to one of a selected range of air-loss mattresses supported thereby. The beds may be hospital or therapeutic beds.

DESCRIPTION OF THE PRIOR ART

Control devices for controlling the pressure and/or volume of air supplied to air-loss mattresses of hospital and therapeutic beds (hereinafter referred to simply as "therapeutic beds") are known. Such apparatus typically enables changes to be made to the pressure of the mattress depending on a patient's needs. The selected air pressure is conventionally displayed in one form or another on or adjacent to the control apparatus. A disadvantage with many such controllers is that the pressure displayed is a measure of the air passing through the controller and not a measure of the pressure of air actually within the mattress. In certain circumstances these pressures may not be the same.

It is also the case that in some air-loss mattresses there is no provision for being able to measure the pressure within the mattress in different areas so as to provide the benefit of variable pressures within the mattress.

SUMMARY OF THE INVENTION

One object of the present invention is to provide control apparatus of the type discussed which responds to remove differences between a desired air pressure set by the controller and the actual air pressure within the mattress.

Hitherto a range of beds has been produced to meet the needs of patients at risk to, for example, the formation of pressure ulcers. Thus, patients are generally categorised as being at low risk, medium risk and high risk. For each such category a different specie of bed and mattress is required to provide the necessary level of patient care to assist the prevention of capillary closure and the onset of skin maceration with the consequent formation of pressure ulcers. To provide a full range of therapeutic beds is both labour intensive and costly.

In one aspect, the present invention provides control apparatus for supplying controlled quantities of air under pressure from a source to an air-loss mattress, the control apparatus including means for setting a required pressure of air flow to the mattress, an open-ended tube connected at one end to pressure recording means with its free end positioned within the flow of air supplied to the mattress to provide a direct measure of the pressure of such supplied air, and means for automatically varying the rate at which air is supplied to the mattress from the source in dependence upon differences existing between the pressure recorded by the pressure recording means and the set pressure to minimise such differences. The free end of the pressure tube may, in use, be positioned within the interior of the mattress.

The invention will now be described by way of example only with reference to the accompanying diagrammatic drawings in which.

DESCRIPTION OF THE PREFERRED EMBODIMENT

Figure 1:
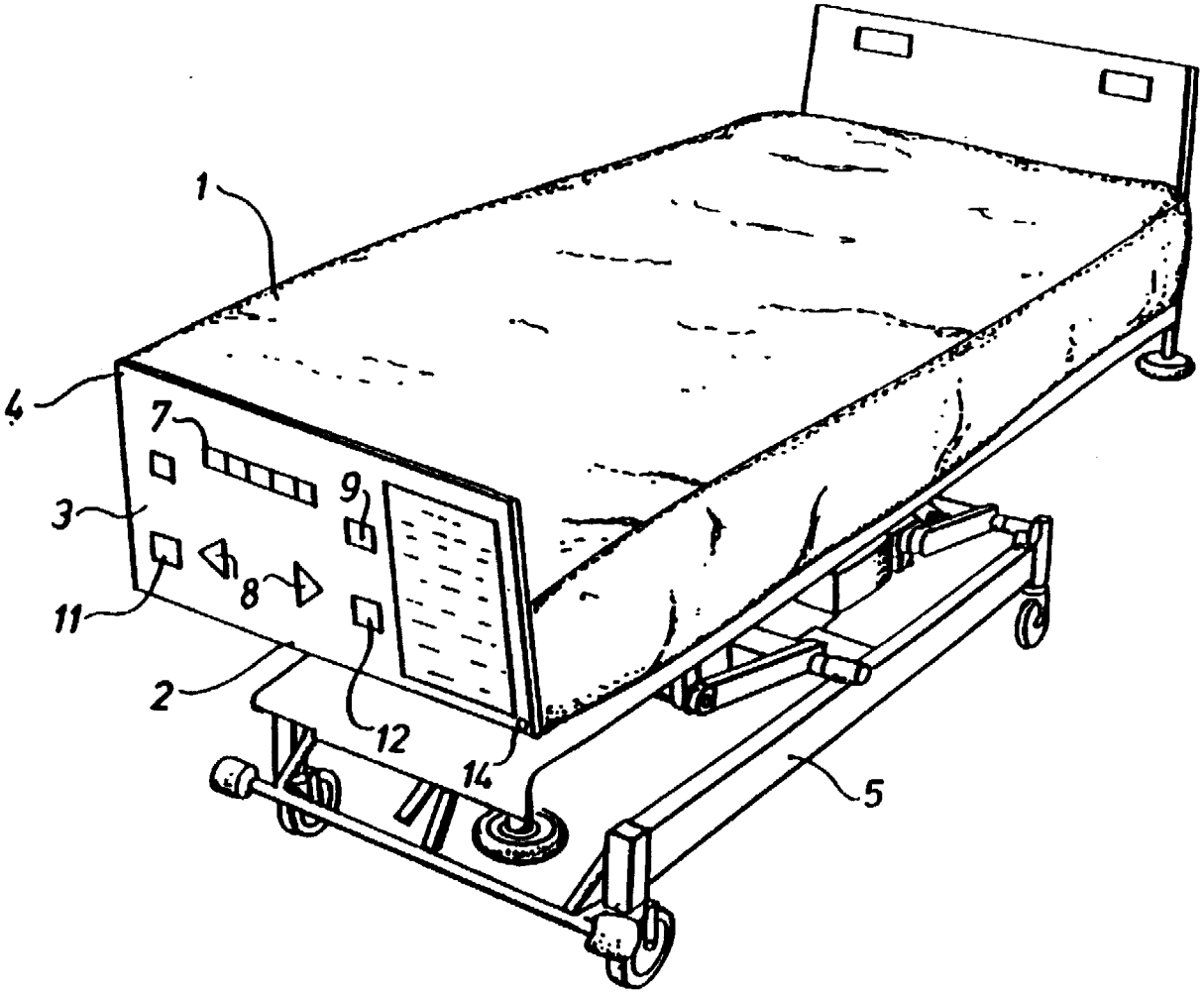
FIG. 1 is a perspective view of a bed in accordance with the invention on which is supported an air-loss mattress.

The bed illustrated in FIG. 1 of the drawings is a conventional electrically operated therapeutic or hospital bed by which patients can automatically be repositioned irrespective of how immobile, heavy, seriously ill or severely injured they may be. Supported on the bed is a low air-loss mattress 1 which is detachably connected to a source of air under pressure through a micro-processor driven controller 2 which operates selectively to vary the pressure of air within the mattress and to maintain this air pressure at a selected value. In the bed illustrated in the drawing, the controller and a display panel 3 form part of the foot rest 4 of the bed and are, therefore formed integrally with the therapeutic bed. The controller and associated air pump are also preferably formed integrally with the bed, these typically being supported on the wheeled support 5 of the bed.

The mattress 1 is connected to the controller through a connector which can be readily disconnected to enable one of a selected range of mattresses to be employed. Thus, the bed is able to receive and control the pressure of a full range of air-loss mattresses simply by connecting a selected mattress via the connector (which may be a push fit connector) to the controller. In this way a single standard therapeutic bed can be used to meet the requirements of all at-risk patients simply by selecting the particular air-loss mattress which meets the nursing requirements of the patient.

The selected air pressure for the mattress is displayed on a segmented colour display 7 positioned generally centrally of the foot rest 4. Other displays may of course be employed. The selected air pressure is varied simply be pressing one or other of two touch pads 8 which form part of the control panel. One touch pad operates to reduce the selected air pressure while the other operates to increase the selected air pressure. The air pressure can be maximised simply by pressing a touch pad 9 to provide a firm setting for, for example, physiotherapy. Also the air pressure may be increased by predetermined percentages when patients are sitting up or lying on one side by pressing one of the touch pads 11, 12. The control apparatus also includes an audio and/or visual alarm which operates in the event of a sudden reduction in air pressure or power loss. Further, the mattress can rapidly be deflated simply by operating a switch 14 which causes air to be sucked from the mattress for, example, cardio pulmonary resuscitation. It will be appreciated that considerable savings in cost will ensue through the use of a standard therapeutic bed able to receive and be connected to one of a range of air-loss mattresses.

Figure 2:
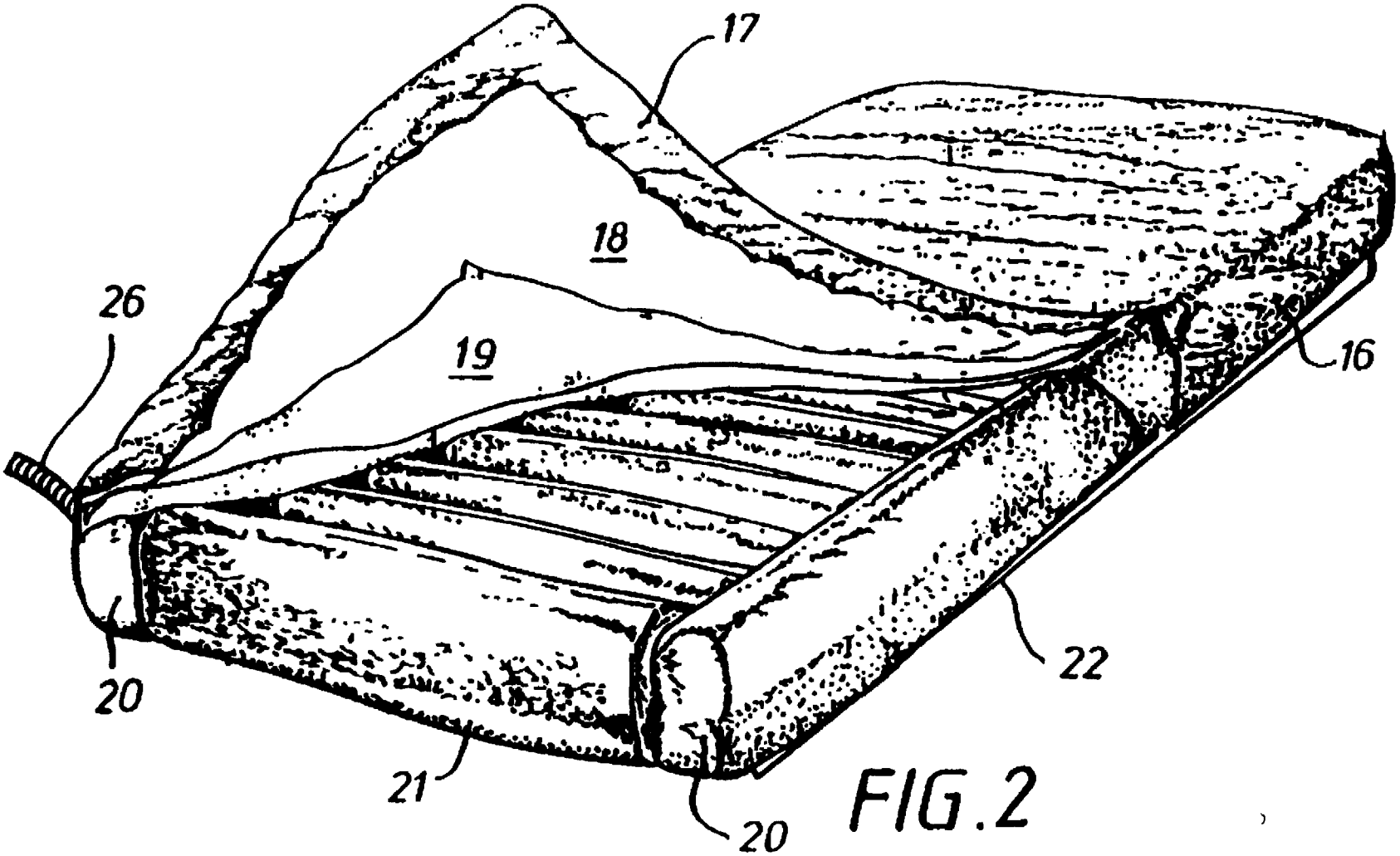
FIG. 2 is a perspective view of the air-loss mattress illustrated in FIG. 1 with its containment envelope partially removed.
Figure 3:
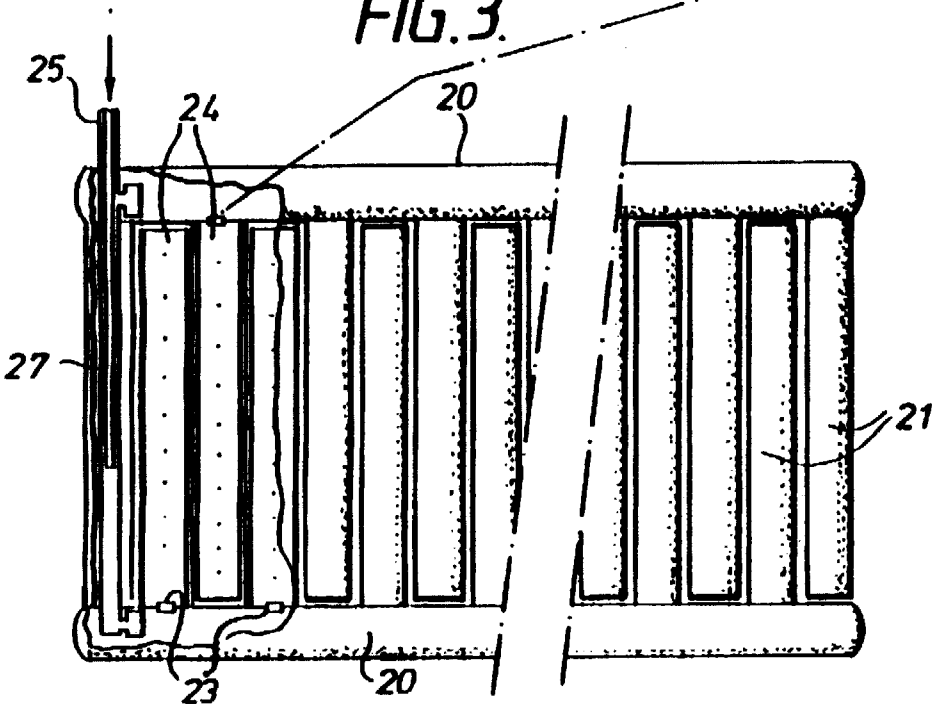
FIG. 3 is a plan view from above partly in section of the mattress illustrated in FIG. 2.

Turing now to FIGS. 2 and 3, the low air-loss mattress illustrated comprises a quilted containment envelope which includes an outer layer 16 of, for example, an ultra soft nylon fabric to minimise skin friction and to aid pressure distribution, a second layer 17 of, for example, breathable urethane to provide a barrier to liquids and bacteria whilst permitting the passage of vapours, a third layer 18 of, for example, Dacron fibre fill to promote osmotic action of urethane and to encourage the dispersal of vapour and a fourth layer 19 of air permeable fabric to reduce friction and to assist in the dispersal of vapour.

The envelope has an integral foam underlay 22 to prevent a patient being at risk during transportation or in the event of a power failure.

Figure 4:
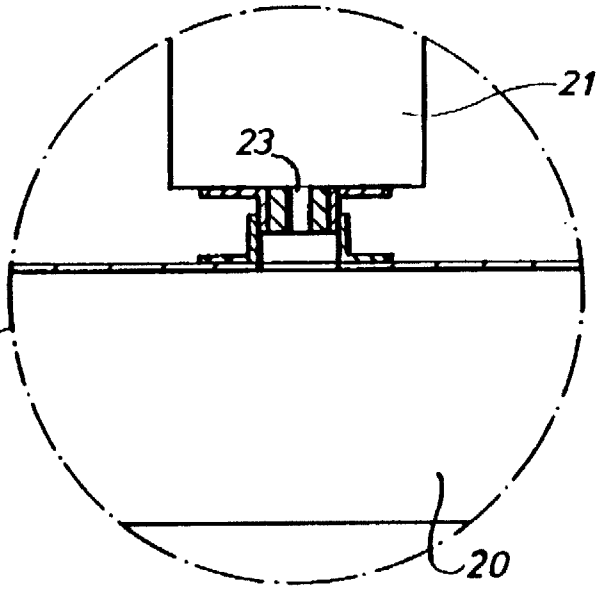
FIG. 4 is a sectional view to an enlarged scale of a releasable connection between a side chamber and an air sack of the mattress shown in FIG. 3.

Contained within the envelope is an assembly of two lengthwise extending inflatable side chambers 20 of an impervious material and a multiplicity of lateral air sacks 21 of a permeable material. Typically eighteen air sacks are provided in a mattress for use by adults. Other numbers of air sacks could however be employed. As will be seen from FIG. 4, the air sacks are connected to the side chambers through restricted orifices 23 whose diameters may vary along the length of the mattress to provide a profiled air pressure. Thus the orifices may be selected to provide a firmer pillow area and a softer heel area. As will be seen from FIG. 3, alternate air sacks are connected to one of the side chambers with the interposing air sacks being connected to the other side chamber.

The air sacks 24 are retained in their side-by-side positions by use of a retaining envelope which comprises upper and lower sheets interconnected by lateral side pieces which co-operate with the upper and lower sheets to define a plurality of laterally extending pockets into each of which one air sack can be positioned. Other similar retention devices can be employed.

Each side chamber is connected to receive air under pressure from a source via a manifold conduit 25. This conduit is in turn connected to receive air under pressure through an outlet pipe 26 of the microprocessor driven controller 2.

The manifold conduit 25 includes a pair of male or female connectors attachable to complementary connectors of the side chambers 20. As mentioned, the side chambers are of impervious material and are consequently each at a higher pressure than that of the permeable air sacks 21.

For any given patient at risk to pressure ulcers it is important that the pressure of air within the mattress is set at a value appropriate to the needs of the patient. It is also extremely important that, once selected, this pressure is not only maintained but is seen to be maintained. To achieve this objective, an open-ended flexible tube 27 is connected at one end to a pressure sensitive diaphragm or the like within the controller 2 and passes through the outlet pipe 26 to a position conveniently midway along the length of the manifold conduit 25 or, if required, to positions within one or each side chamber. Alternatively, the tube 27 may extend to a position within the pipe 26. The pressure sensitive tube 27 relays to the controller 2 the actual pressure of the air supplied to or within the mattress and activates a comparator of the microprocessor to increase or decrease the flow of air to the mattress through the pipe 26 in the event that the required pressure differs from the measured pressure.

In use, the several air pressure sacks are supplied with air under pressure from the side chambers 20, this air replenishing the air which is constantly leaving the sacks through the holes 24. The pressure of air within the individual sacks may differ depending upon the size of orifices 24 employed. The side chambers are in turn supplied with air under pressure from the manifold. Because, as mentioned previously, the side chambers are in use subjected to higher air pressures than that within the air sacks, they operate to provide a firm edge to each mattress side to provide support to a patient when getting into and out of bed. Also, these side chambers tend to cradle the patient to give a feeling of support. In use, the side chambers lie at the same level or stand proud of the air sacks 21.

The low air-loss mattress described in just one of a full range of such mattresses which can be supplied by a therapeutic bed in accordance with the invention.

It will be appreciated that the foregoing is merely exemplary of therapeutic beds in accordance with the invention and that modifications can readily be made thereto without departing from the true scope of the invention as set out in the appended Claims.

I claim:

1. An air-loss mattress to which air under pressure is supplied from a source, control apparatus for controlling the supply of air under pressure from the source to the air-loss mattress through a connector which form part of the mattress, and means included in the control apparatus for setting a required pressure of air flow to the mattress, the air-loss mattress being characterized in that it includes a manifold conduit connected to the source of air under pressure through an outlet pipe of the control apparatus, an open-ended tube connected at one end to pressure recording means of the control apparatus with its free end positioned within the manifold conduit to provide a direct measure of the pressure of air present within this manifold, and means for automatically varying the rate at which air is supplied to the mattress from the source in dependence upon differences existing between the pressure recorded by the pressure recording means and the set pressure in a sense to minimize such differences.

2. An air-loss mattress as claimed in claim 1 which comprises two inflatable side chambers extending lengthwise of the mattress and a plurality of air sacks extending laterally of the mattress and between the side chambers, each air sack being connected to one of the side chambers through a releasable connector including a restricted orifice.

3. Control apparatus as claimed in claim 2 wherein the free and of the open-ended pressure measuring tube protrudes into a manifold connected to supply air under pressure to both side chambers.

4. Control apparatus as claimed in claim 2 wherein the manifold is releasably connected to both side chambers.

* * * * *